US007425117B2

(12) United States Patent
Robinson et al.

(10) Patent No.: US 7,425,117 B2
(45) Date of Patent: Sep. 16, 2008

(54) SYSTEM AND METHOD FOR REDUCING BACK FLOW

(75) Inventors: Scott Louis Robinson, Chippewa Falls, WI (US); Richard Byron Salmonson, Chippewa Falls, WI (US)

(73) Assignee: Silicon Graphics, Inc., Sunnyvale, CA (US)

( * ) Notice: Subject to any disclaimer, the term of this patent is extended or adjusted under 35 U.S.C. 154(b) by 200 days.

(21) Appl. No.: 11/343,968

(22) Filed: Jan. 31, 2006

(65) Prior Publication Data

US 2006/0194533 A1 Aug. 31, 2006

Related U.S. Application Data

(60) Provisional application No. 60/648,668, filed on Jan. 31, 2005.

(51) Int. Cl.
*F01D 7/00* (2006.01)

(52) U.S. Cl. ..... 416/44; 416/131; 415/141

(58) Field of Classification Search ..... 415/140, 415/141, 146, 147; 416/131, 179, DIG. 5, 416/44

See application file for complete search history.

(56) References Cited

U.S. PATENT DOCUMENTS

| | | | | |
|---|---|---|---|---|
| 3,006,534 | A * | 10/1961 | McDonald | 416/186 R |
| 6,386,826 | B1 * | 5/2002 | Jacob | 415/125 |
| 6,474,936 | B1 * | 11/2002 | deBlanc et al. | 415/25 |
| 6,547,519 | B2 * | 4/2003 | deBlanc et al. | 415/141 |
| 7,184,268 | B2 * | 2/2007 | Espinoza-Ibarra et al. | 361/695 |

* cited by examiner

*Primary Examiner*—Edward Look
*Assistant Examiner*—Nathaniel Wiehe
(74) *Attorney, Agent, or Firm*—Schwegman, Lundberg & Woessner, P.A.

(57) ABSTRACT

A system and method of reducing back flow in an air mover having one or more blades is described. A flap is attached to a blade of the air mover such that, when back flow occurs, the flap obscures all or a portion of the space between blades during back flow.

5 Claims, 3 Drawing Sheets

SYSTEM AND METHOD FOR REDUCING BACK FLOW

CROSS-REFERENCE TO RELATED APPLICATION(S)

This application claims the benefit of U.S. Provisional Application Ser. No. 60/648,668, filed Jan. 31, 2005, under 35 U.S.C. 119(e), which is incorporated herein by reference in its entirety.

BACKGROUND OF THE INVENTION

1. Field of the Invention

The present invention is related to air mover systems, and more particularly to a system and method for reducing back flow in failed air movers.

2. Background Information

Air movers are used in computer systems to increase the flow of air past components. In systems requiring large volumes of air, two or more air movers may be used to provide the needed air flow. When one of the air movers fails, it provides a low resistance path for air from the other mover to flow out of the system, severely reducing the air flow to the components being cooled.

In the past, air movers have been designed with gravity flaps. The gravity flaps fall shut when the air flow through the flap is insufficient to overcome the effect of gravity on the flap. When shut the gravity flap prevents back flow back through the air mover.

Gravity flap systems are, however, orientation sensitive. In addition, the gravity flap takes up additional space in the blower assembly.

What is needed is a system and method for reducing back flow which addresses these deficiencies, and others that will become apparent while reading the following description.

DETAILED DESCRIPTION OF THE INVENTION

In the following detailed description of the preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

Figure 1:
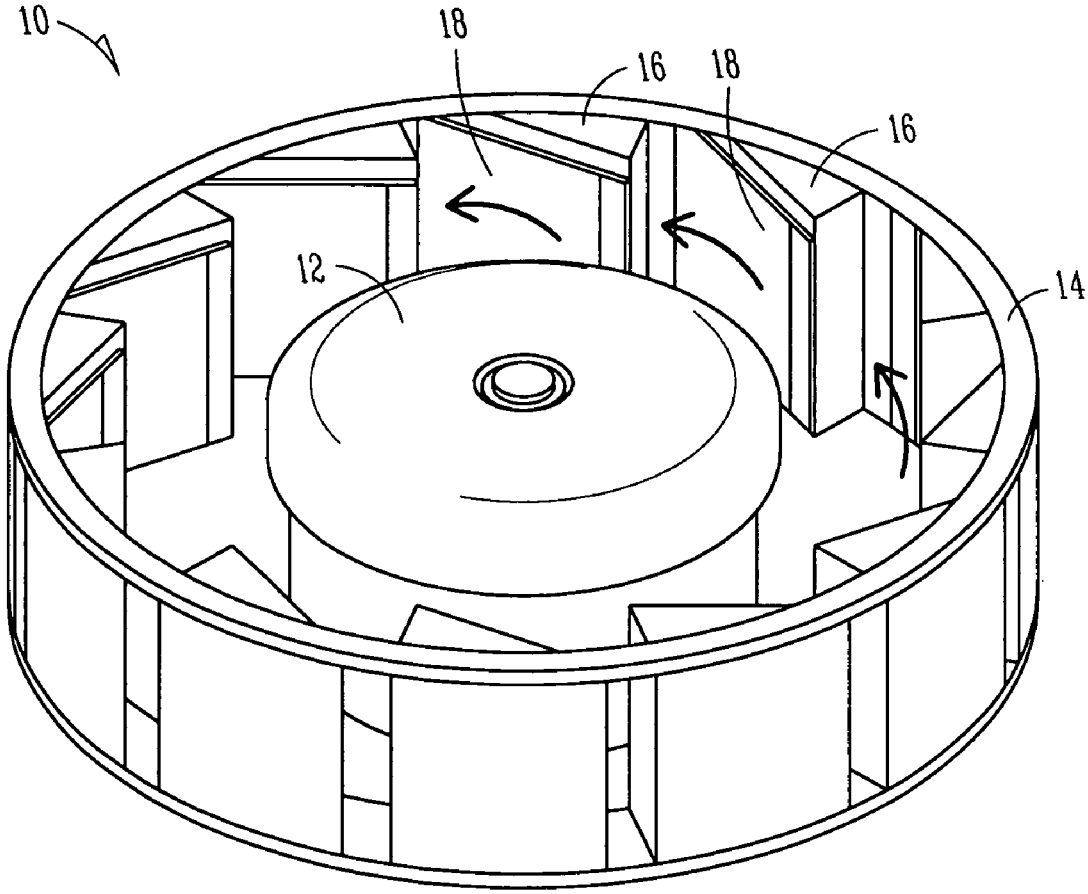
FIG. 1 illustrates an air mover.

FIG. 1 illustrates an air mover. In the assembly shown in FIG. 1, air mover 10 includes a motor 12 and an air mover blade assembly 14. In the embodiment shown in FIG. 1, air mover blade assembly 14 includes two or more blades 16 mounted within the air mover blade assembly 14 at a fixed orientation.

When air mover 10 is operating, air is pushed through blade assembly 14 in the direction shown by the arrows.

As noted above, in systems requiring large volumes of air, two or more air movers 10 may be used to provide the needed air flow. When one of the air movers fails, it provides a low resistance path for air from the other mover to flow out of the system, severely reducing the air flow to the components being cooled.

To prevent this, in the embodiment shown in FIG. 1, a flap 18 is attached to one or more of the blades 16 and oriented such that each flap 18 covers all or a portion of the space between blades 16 when the mover 10 fails and a back flow of air through air mover 10 is occurring.

Figure 3:
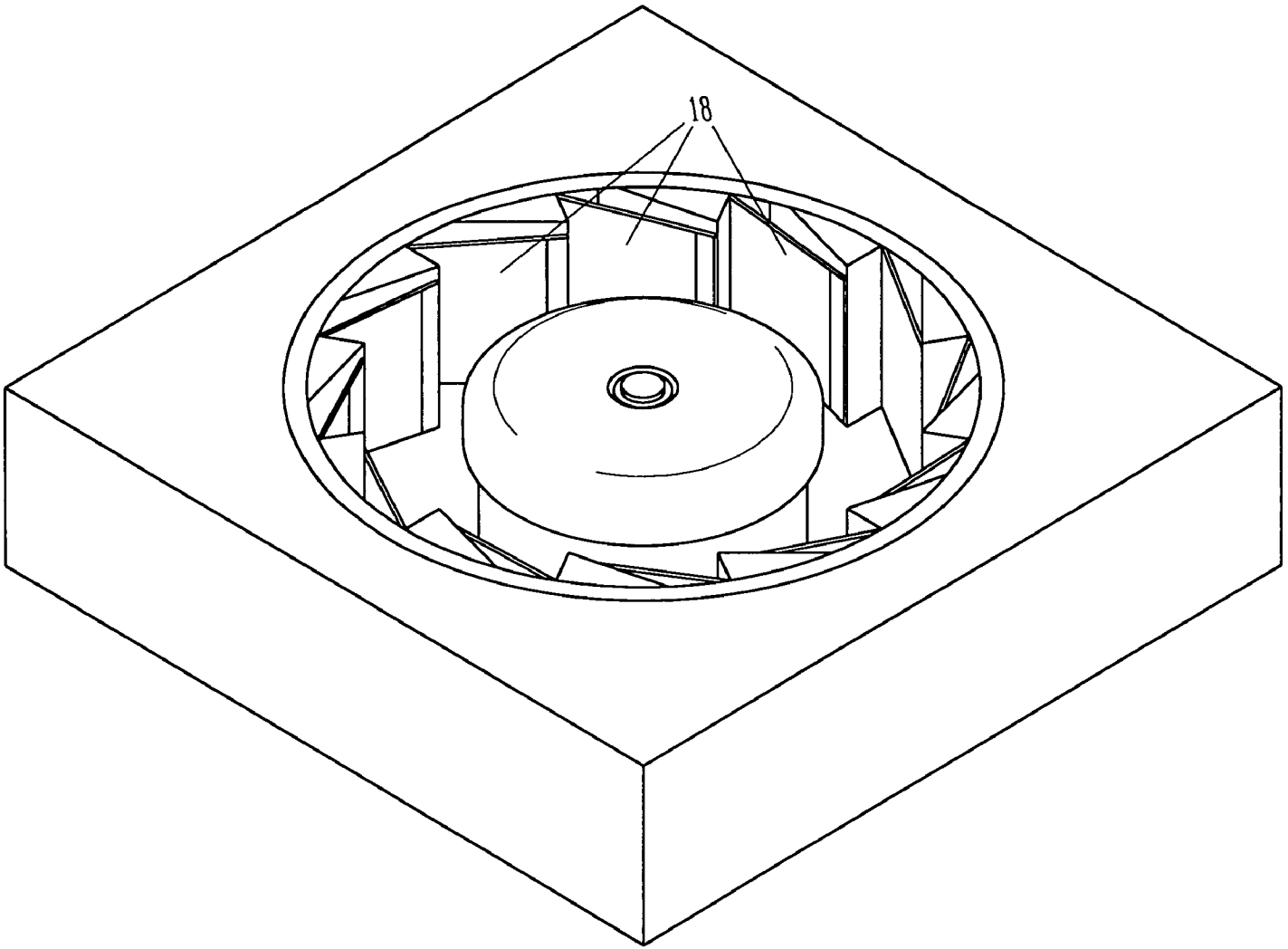
FIG. 3 illustrates an air mover with flaps closed.

In one embodiment, flap 18 hinges such that it is located at or close to the leading edge of blade. Centrifugal force and Air pressure hold the flap 18 open; when the blower fails suction from the other blowers in the system pulls the flaps closed. An assembly with closed flaps 18 is shown in FIG. 3.

Figure 2:
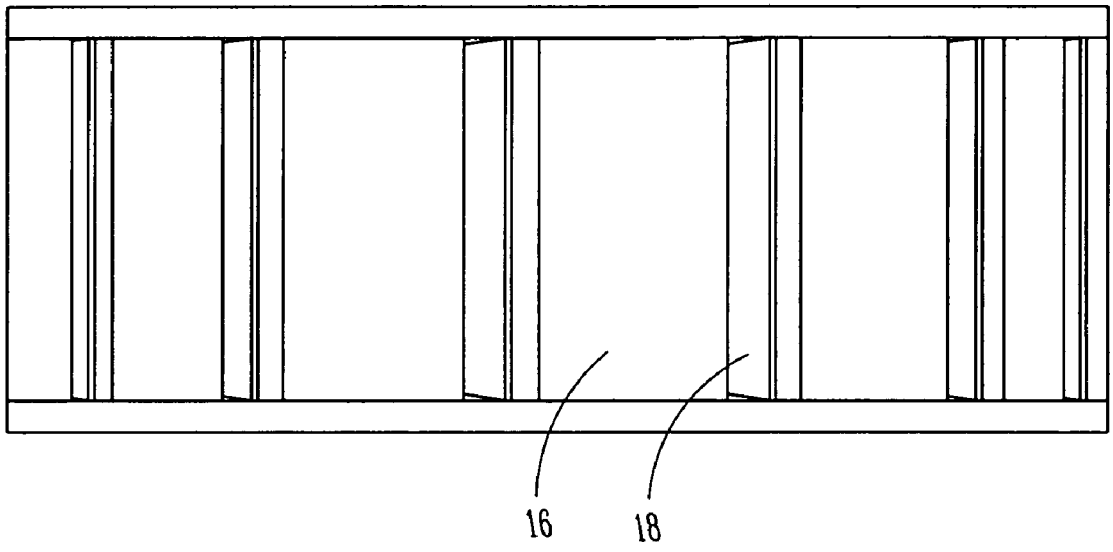
FIG. 2 illustrates an alternate view of the air mover of FIG. 1.

An alternate embodiment is shown in FIG. 2. In the embodiment shown in FIG. 2, the length of flap 18 extends beyond the outer diameter of the blade assembly. Such an embodiment physically increases the diameter of the blower and improves blade performance at lower RPMs.

Air mover 10 operates in any orientation and, if back flow pressure is sufficient, it is not effected by gravity. In addition, by incorporating flap 18 into blade assembly 14, air mover 10 takes up less space in the system.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is intended that this invention be limited only by the claims and the equivalents thereof.

What is claimed is:

1. An air mover, comprising:

a motor;

a blade assembly attached to the motor, wherein the blade assembly includes two or more blades; and a flap attached to one or more of the blades and oriented such that each flap is capable of covering all or substantially all of the space between blades, wherein each flap normally remains substantially open when the blade assembly is not rotating but shut in the presence of back flow.

2. The air mover according to claim 1, wherein the flap extends beyond the outer diameter of the blade assembly.

3. A blade assembly, comprising:

a mounting device for attaching the blade assembly to a motor;

two or more blades attached to the mounting device and configured to rotate around the motor when in operation; and one or more flaps, wherein each flap is attached to one of the blades and oriented such that each flap is capable of covering all or substantially all the space between blades, wherein each flap normally remains substantially open when the blade assembly is not rotating but shuts in the presence of back flow.

4. The blade assembly according to claim 3, wherein the flap extends beyond the outer diameter of the blade.

5. A method of reducing back flow in an air mover having a motor, comprising:

forming a mounting device for attaching a blade assembly to the motor;

attaching two or more blades to the mounting device, the blades being configured to rotate around the motor when in operation;

forming one or more flaps; and attaching each flap to one of the blades such that the flap is capable of obscuring all or substantially all of the space between blades, wherein each flap normally remains substantially open when the blade assembly is not rotating but shuts in the presence of back flow.

* * * * *

UNITED STATES PATENT AND TRADEMARK OFFICE

CERTIFICATE OF CORRECTION

PATENT NO. : 7,425,117 B2
APPLICATION NO. : 11/343968
DATED : September 16, 2008
INVENTOR(S) : Robinson et al.

It is certified that error appears in the above-identified patent and that said Letters Patent is hereby corrected as shown below:

In column 2, line 34, in Claim 1, delete “shut” and insert -- shuts --, therefor.

In column 2, line 46, in Claim 3, before “the” insert -- of --.

Signed and Sealed this

Ninth Day of December, 2008

JON W. DUDAS
*Director of the United States Patent and Trademark Office*